US007546076B2

(12) United States Patent
Fuchiwaki et al.

(10) Patent No.: US 7,546,076 B2
(45) Date of Patent: Jun. 9, 2009

(54) IMAGE FORMING APPARATUS AND TRANSFER MEDIUM GUIDING APPARATUS USED THEREIN

(75) Inventors: Takashi Fuchiwaki, Kanagawa (JP); Tetsuya Furuyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 149 days.

(21) Appl. No.: 11/029,649

(22) Filed: Jan. 6, 2005

(65) Prior Publication Data

US 2005/0201782 A1 Sep. 15, 2005

(51) Int. Cl.
*G03G 15/16* (2006.01)

(52) U.S. Cl. ..... 399/316; 399/388

(58) Field of Classification Search ..... 399/316, 399/388

See application file for complete search history.

(56) References Cited

U.S. PATENT DOCUMENTS 3,754,526 A * 8/1973 Caudill
5,276,489 A * 1/1994 Kikuchi et al. ..... 399/316
5,594,539 A * 1/1997 Murano et al. ..... 399/316
5,787,330 A * 7/1998 Funato
6,125,244 A * 9/2000 Kamiya ..... 399/388
6,731,890 B1 * 5/2004 Rakov et al.
2004/0190919 A1 9/2004 Iwasaki et al.

FOREIGN PATENT DOCUMENTS

| | | | |
|---|---|---|---|
| CN | 1534390 A | | 10/2004 |
| JP | 4-355482 | | 9/1992 |
| JP | 08328397 A | * | 12/1996 |
| JP | 10-123848 | | 5/1998 |
| JP | 2003-076154 | | 3/2003 |

* cited by examiner

*Primary Examiner*—David M Gray
*Assistant Examiner*—Laura K Roth
(74) *Attorney, Agent, or Firm*—Morgan, Lewis & Bockius LLP

(57) ABSTRACT

An image forming apparatus includes an image carrier that supports an image, a contact transfer member that sandwiches a transfer medium in a transfer area between the contact transfer member and the image carrier and electrostatically transfers the image on the image carrier onto the transfer medium, and a transfer medium guiding device to guide the transfer medium to the transfer area between the image carrier and the contact transfer member.

8 Claims, 11 Drawing Sheets

FIG. 10

| GAP k (mm) BETWEEN IMAGE CARRIER AND FRONT END OF LEFT GUIDE CHUTE | ANGLE θ (DEGREE) FORMED BETWEEN IMAGE CARRIER CONTACT PLANE AND TRANSFER PAPER | 10 | 20 | 30 | 40 | 45 | 50 | 55 | 60 | 70 |
|---|---|---|---|---|---|---|---|---|---|---|
| 0.5 | IMAGE QUALITY DEFECT (WHITE SPOTS/SCATTERING) | C | C | C | D | D | D | D | D | D |
| | SHEET CONVEYABILITY (JAM) | A | A | B | C | C | C | C | C | C |
| 1.0 | IMAGE QUALITY DEFECT (WHITE SPOTS/SCATTERING) | C | C | C | B | A | A | A | A | D |
| | SHEET CONVEYABILITY (JAM) | A | A | A | A | A | A | A | A | C |
| 1.5 | IMAGE QUALITY DEFECT (WHITE SPOTS/SCATTERING) | C | C | C | B | A | A | A | A | D |
| | SHEET CONVEYABILITY (JAM) | A | A | A | A | A | A | A | A | C |
| 2.0 | IMAGE QUALITY DEFECT (WHITE SPOTS/SCATTERING) | C | C | C | B | A | A | A | A | B |
| | SHEET CONVEYABILITY (JAM) | A | A | A | A | A | A | A | A | B |
| 2.5 | IMAGE QUALITY DEFECT (WHITE SPOTS/SCATTERING) | C | C | C | C | A | A | A | A | C |
| | SHEET CONVEYABILITY (JAM) | A | A | A | A | A | A | A | A | A |
| 3.0 | IMAGE QUALITY DEFECT (WHITE SPOTS/SCATTERING) | C | C | C | C | C | C | C | C | C |
| | SHEET CONVEYABILITY (JAM) | A | A | A | A | A | A | A | A | A |

FIG. 11

| DISTANCE d (mm) FROM FRONT END OF LEFT GUIDE CHUTE TO FRONT END OF FLEXIBLE RETAINER PART | WHITE SPOTTING | TRANSFER PAPER REAR-END SPRING | TRANSFER PAPER FRONT-END BLOTTING |
|---|---|---|---|
| 2.5 | A | A | C |
| 3.5 | A | A | A |
| 4.5 | A | A | A |
| 5.5 | A | A | A |
| 6.5 | B | C | A |
| 7.5 | C | C | A |

IMAGE FORMING APPARATUS AND TRANSFER MEDIUM GUIDING APPARATUS USED THEREIN

BACKGROUND OF THE INVENTION

1. Field of the Invention

The present invention relates to an image forming apparatus such as a copying machine or a printer, and in particular, an improvement in an image forming apparatus in a mode of using a contact transfer member whose transfer medium is sandwiched in a transfer area between the same and an image carrier, and a transfer medium guiding device used therein.

2. Description of the Related Art

Conventionally, as an image forming apparatus of this type, in, for example, electrophotography, ones have already been provided, wherein a transfer device is disposed facing an image carrier such as a photosensitive drum and a toner image electrostatically formed on the image carrier onto a transfer medium by this transfer device.

As transfer devices of this type, non-contact type devices such as corotrons also exist, however, from a point of view of suppressing ozone generation, contact-type devices such as transfer rolls which sandwich a transfer medium in a transfer area between the same and an image carrier have been often utilized.

In such a mode of utilizing a contact-type transfer device, it is required that the transfer medium is securely closely arranged on the image carrier in the transfer area between the image carrier and transfer roll to maintain transferability by the transfer roll satisfactorily.

In order to satisfy such a requirement, conventionally, ones have been known wherein, in order to guide a transfer medium to a transfer area between the image carrier and transfer roll, a transfer medium guiding device has been disposed, in a transfer medium transporting path, at an upstream side of the transfer area. For this transfer medium guiding device, ones having paired guide chutes whereby a transfer medium is made to contact the image carrier at an upstream and outside portion of the transfer area, for pressing the transfer medium to the image carrier side by use of resilience of the transfer medium so as to closely arrange the transfer medium on the image carrier in the transfer area have been known (see JP-A-4-355482, JP-A-10-123848, and JP-A-2003-76154, for example.)

However, in the transfer medium guiding devices of this type as described in JP-A-4-355482, JP-A-10-123848, and JP-A-2003-76154, there are concerns that a gap occurs between the image carrier and transfer medium in the transfer area, wherein a technical problem exists such that, if such a gap exists, an electric discharge is produced by a transfer voltage (current), and deletion and toner scattering occur.

Such inconveniences more clearly appear when a high-triboelectric toner is used than when a low-triboelectric toner is used, since a high transfer current or transfer voltage is required.

The invention has been made in order to solve the above technical problems, and provides an image forming apparatus which can secure adhesion between an image carrier and a contact transfer member to satisfactorily maintain transferability by the contact transfer member and a transfer medium guiding device used therein.

The present inventors have analyzed the above-mentioned technical problems and have obtained the following knowledge.

For example, in the transfer medium guiding device described in JP-A-4-355482, since an angle formed between the contact plane and transfer medium in a contact posture at a contact part of the transfer medium into the image carrier is less than 45°, a pressing force for the transfer medium against the image carrier is weak, and adhesion between the image carrier and transfer medium is likely to become insufficient. Moreover, since a gap between the guide chutes and image carrier is large, the transfer medium easily floats up from the image carrier surface particularly when a transfer medium with a strong resilience is used.

In addition, in the transfer medium guiding device described in JP-A-10-123848, a flexible shielding plate to elastically contact one of the paired guide chutes is provided, blots on a transfer medium transporting surface of the guide chute is prevented by this shielding plate, and the contact posture of the transfer medium is regulated in a direction toward the transfer area by the shielding plate. Accordingly, a pressing force for the transfer medium against the image carrier is weak, and adhesion between the image carrier and transfer medium is likely to become insufficient.

Furthermore, the transfer medium guiding device described in JP-A-2003-76154 is for guiding the transfer material which has been wound around the image carrier to a nipping area, wherein it is apparent that an angle of the transfer medium in a contact posture is less than 45°, and for this, a pressing force for the transfer medium against the image carrier is weak, and adhesion between the image carrier and transfer medium is likely to become insufficient.

Based on such results of analysis, the present inventors have obtained knowledge that adhesion between the image carrier and transfer medium is secured by improving a pressing force for the transfer medium against the image carrier, and the transfer medium with a strong resilience is prevented from floating up from the image carrier by adjusting a lead edge position of the guide chute closer to the transfer area.

SUMMARY OF THE INVENTION

According to an aspect of the present invention, an image forming apparatus includes an image carrier that supports an image, a contact transfer member that sandwiches a transfer medium in a transfer area between the contact transfer member and the image carrier and electrostatically transfers the image on the image carrier onto the transfer medium, and a transfer medium guiding device to guide the transfer medium to the transfer area between the image carrier and the contact transfer member. The transfer medium guiding device has a pair of guide chutes that guide the transfer medium to make the transfer medium contact the outside and upstream portion of the transfer area of the image carrier, an angle formed between a contact plane on the image carrier and the transfer medium at a contact point is 45° or more and 60° or less, and a distance between one of the guide chutes closer to the transfer area and the image carrier is 1.0 mm or more and 2.5 mm or less.

According to an embodiment of the present invention, a transfer medium guiding device is integrated in an image forming apparatus including an image carrier that supports an image, a contact transfer member that sandwiches a transfer medium in a transfer area between the contact transfer member and the image carrier and electrostatically transfers the image on the image carrier onto the transfer medium, and a transfer medium guiding device to guide the transfer medium to the transfer area between the image carrier and the contact transfer member. The transfer medium guiding device has a pair of guide chutes that guide the transfer medium to make the transfer medium contact the outside and upstream portion of the transfer area of the image carrier, an angle formed between a contact plane on the image carrier and the transfer medium at a contact point is 45° or more and 60° or less, and a distance between one of the guide chutes closer to the transfer area and the image carrier is 1.0 mm or more and 2.5 mm or less.

BRIEF DESCRIPTION OF THE DRAWINGS

Embodiments of the present invention will be described in detail based on the following figures, wherein:

FIG. 10 is an explanatory view showing presence or absence of image quality defect occurrence in respective cases while changing, in Embodiment 1, a gap formed between the image carrier and lead edge of a left guide chute and an angle formed between the image carrier contact plane and transfer paper as parameters; and FIG. 11 is an explanatory view showing presence or absence of image quality defect occurrence in respective cases while changing, in Embodiment 2, a distance from the lead edge of a left guide chute to the lead edge of a flexible member as a parameter.

DETAILED DESCRIPTION OF THE INVENTION

Figure 1:
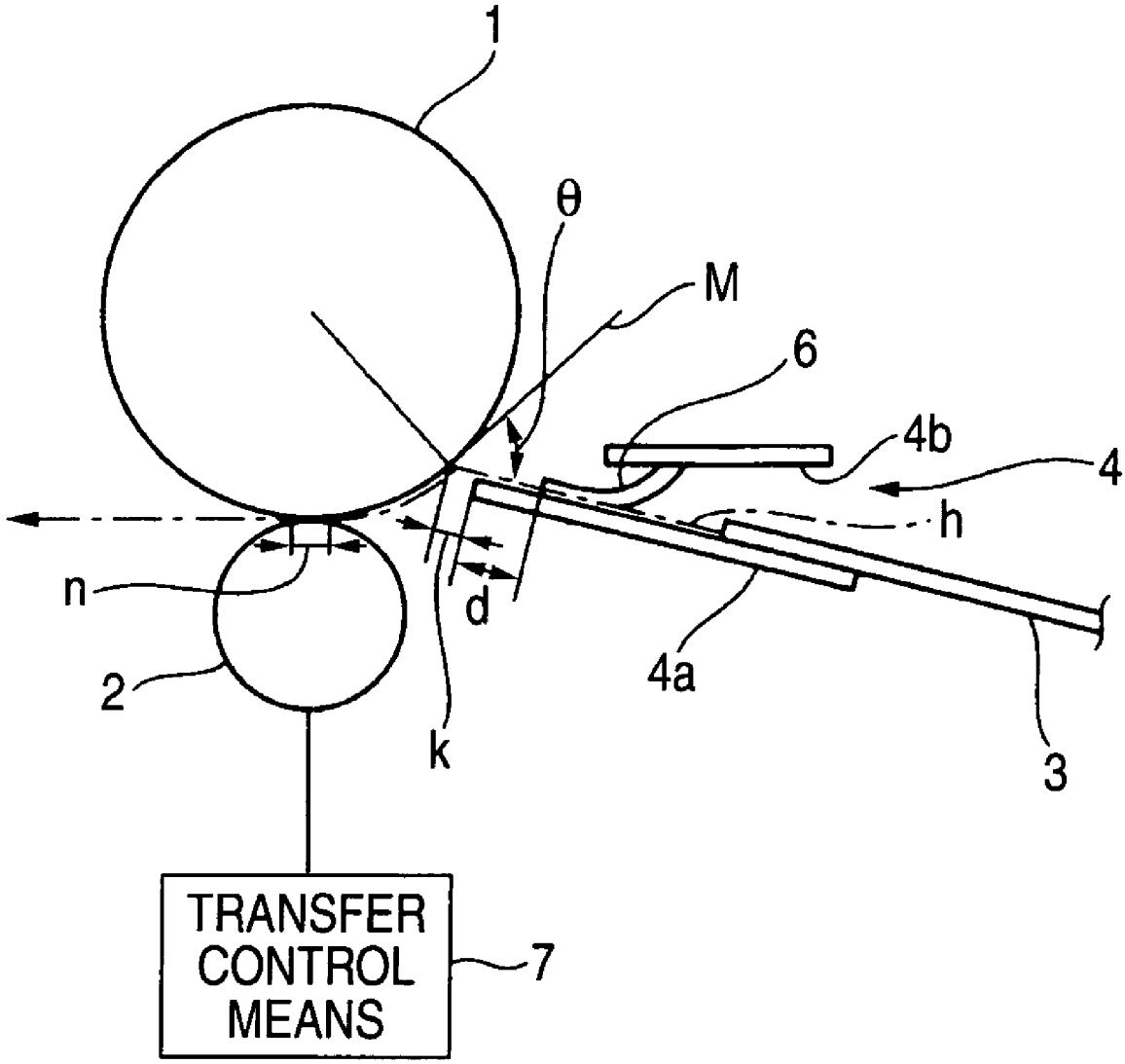
FIG. 1 is an explanatory view showing an outline of an image forming apparatus according to the present invention and a transfer medium guiding device to be used therein.

As shown in FIG. 1, in an image forming apparatus including an image carrier 1 for carrying an image, a contact transfer member 2 for sandwiching a transfer medium 3 between the same and this image carrier 1 and electrostatically transferring an image on the image carrier 1, and a transfer medium guiding device 4 for guiding the transfer medium 3 to the transfer area n between the image carrier 1 and contact transfer member 2, the present invention is characterized in that the transfer medium guiding device 4 has paired guide chutes 4*a* and 4*b* thereby the transfer medium 3 is guided so that the transfer medium 3 is made to contact an upstream and outside portion of the transfer area n, and where an angle (transfer member contact angle) formed between a contact plane M and the transfer medium 3 in a contact posture h is provided as θ and a gap between the guide chute 4 closer to the transfer area n and image carrier 1 is provided as k, $45° \leqq \theta \leqq 60°$ and $1.0\ \text{mm} \leqq k \leqq 2.5\ \text{mm}$ are satisfied.

In such a technical unit, the present invention is aimed at an image forming apparatus provided with the contact transfer member 2 and transfer medium guiding device 4.

Herein, although the image carrier 1 is aimed mainly at one in a drum form, this may be in a belt form laid in a tensioned condition across a roll for tensioned laying. In addition, without being limited to an image forming carrier such as a photo conductor, this also includes an intermediate transfer body. Furthermore, it is sufficient that the contact transfer member 2 sandwiches the transfer medium 3 in the transfer area n between the same and image carrier 1, and this is normally arranged in contact with the image carrier 1, however, this may be arranged in proximity to the image carrier 1.

In addition, an image material such as a toner is used for an image on the image carrier 1, and electrically charging characteristics of the image material are arbitrary. However, when a high-triboelectric material is used, since a higher transfer voltage (current) is required than that with a low triboelectric material, the technical problem of the present invention (a transfer failure as a result of an adhesion failure of the transfer medium 3 to the image carrier 3) easily occurs. In this regard, since an adhesion failure of the transfer medium 3 to the image carrier 1 can be improved in the present application, the present invention is especially effective when a high-triboelectric image material is used. The high-triboelectric material herein mentioned indicates one provided with charging characteristics of 10 to 40 μC/g under a high-humidity environment (a temperature of 28° C./a humidity of 85%, for example.) Here, a low-triboelectric material indicates one provided with charging characteristics of 3 to 10 μC/g under a high-humidity environment.

Furthermore, since it easily leads to high-triboelectricity that a mean particle diameter of the image material is a small diameter not more than 8 μm and the image material is a non-magnetic toner, the present invention is especially effective.

Furthermore, it is necessary that the transfer medium guiding device 4 be provided with the paired guide chutes 4*a* and 4*b* in a meaning of regulating the transporting direction of the transfer medium 3. Since these guide chutes 4*a* and 4*b* are on the premise that these guide chutes 4*a* and 4*b* guide the transfer medium 3 to the transfer area n while making the same in close contact with the image carrier 1, a contact point of the transfer medium 3 is, in the image carrier 1, at an upstream part outside the transfer area n, and a mode of the transfer medium 3 being guided directly to the transfer area n is not included.

As a mode for guiding the transfer medium 3 by the transfer medium guiding device 4, one for guiding and transporting the transfer medium 3 along the guide chute 4*a* closer to the transfer area n is preferable, and according to the present mode, contact posture of the transfer medium 3 can be stabilized.

Furthermore, as a constructional example of the guide chutes 4*a* and 4*b*, although these may be formed in an appropriate shape by a material such as metal, the guide chute 4*a* closer to the transfer area n may be provided integrally with a holder of the contact transfer member 2. According to the present mode, positioning of the guide chute 4*a* closer to the transfer area n is easy, which is favorable.

In addition, in the present invention, in particular, as layout requirements for the guide chutes 4*a* and 4*b*, the following two are required.

First, the transfer medium contact angle θ requires that $45° \leqq \theta \leqq 60°$. This numerical range is based on that, if the transfer contact angle θ is less than 45°, adhesion between the image carrier 1 and transfer medium 3 becomes difficult, and if it exceeds 60°, transportability of the transfer medium 3 to the transfer area n is lost.

Second, the gap k between the guide chute 4*a* closer to the transfer area n and image carrier 1 requires that $1.0\ \text{mm} \leqq k \leqq 2.5\ \text{mm}$. This numerical range is based on that, if the gap k is less than 1 mm, transportability of the transfer medium 3 to the transfer area n is lost, and if it exceeds 2.5 mm, adhesion between the image carrier 1 and transfer medium 3 is easily lost by a floating up of the transfer medium 3 with a strong resilience.

In addition, as a mode of the transfer medium guiding device 4, one provided with a flexible retainer member 6 whose lead edge portion contacts a transfer medium transporting surface of the guide chute 4*a* closer to the transfer area n can be mentioned. According to the present mode, a trail edge spring of the transfer medium 3 is suppressed by the flexible retainer member 6, and an image distortion by a transfer medium 3 vibration as a result of a trail edge spring can be prevented.

And, as a layout of the flexible retainer member 6, it is preferable that, where a gap between the lead edge of the guide chute 4*a* closer to the transfer area n and the lead edge of a contact portion with the flexible retainer member 6 is provided as d, 3.5 mm≦d≦5.5 mm is satisfied. Herein, with less than 3.5 mm, there is a concern for lead edge contamination of the transfer medium 3 as a result of lead edge contamination of the flexible retainer member 6, while if it exceeds 5.5 mm, there is a concern for an image distortion as a result of a trail edge spring of the transfer medium 3.

In addition, a transfer control unit 7 is provided for the contact transfer member 2, and this transfer control unit 7 controls a transfer bias to be applied to the contact transfer member 2.

As a control method for this transfer control unit 7, one for applying, in response to a pass timing of at least a trail edge portion of the transfer medium 3, a bias to be a low-current or low-voltage with the same polarity as that of a transfer bias can be mentioned. According to the present mode, while maintaining tranferability at, at least, the trail edge portion of the transfer medium 3 to some degree, by weakening adhesion power of at least the trail edge portion of the transfer medium 3, an image distortion as a result of a trail edge spring of the transfer medium 3 when the same peels from the image carrier 1 can be effectively prevented.

Furthermore, the present invention is not limited to an image forming apparatus but aims at a transfer medium guiding device itself, as well.

In this case, as the present invention, in, as shown in FIG. 1, a transfer medium guiding device 4 which is incorporated in an image forming apparatus including an image carrier 1 for carrying an image and a contact transfer member 2 for sandwiching a transfer medium 3 between the same and this image carrier 1 and electrostatically transferring an image on the image carrier 1 and which guides the transfer medium 3 to the transfer area n between the image carrier 1 and contact transfer member 2, it is sufficient to have paired guide chutes 4*a* and 4*b* whereby the transfer medium 3 is guided so that the transfer medium 3 is made to contact an upstream and outside portion of the transfer area n, and satisfy 45°≦θ≦60° and 1.0 mm≦k≦2.5 mm where an angle formed between a contact plane M and the transfer medium 3 in a contact posture h is provided as θ and a gap between the guide chute 4 closer to the transfer area n and image carrier 1 is provided as k.

Hereinafter, the present invention will be described in detail based on an embodiment shown in the attached drawings.

EMBODIMENT 1

Figure 2:
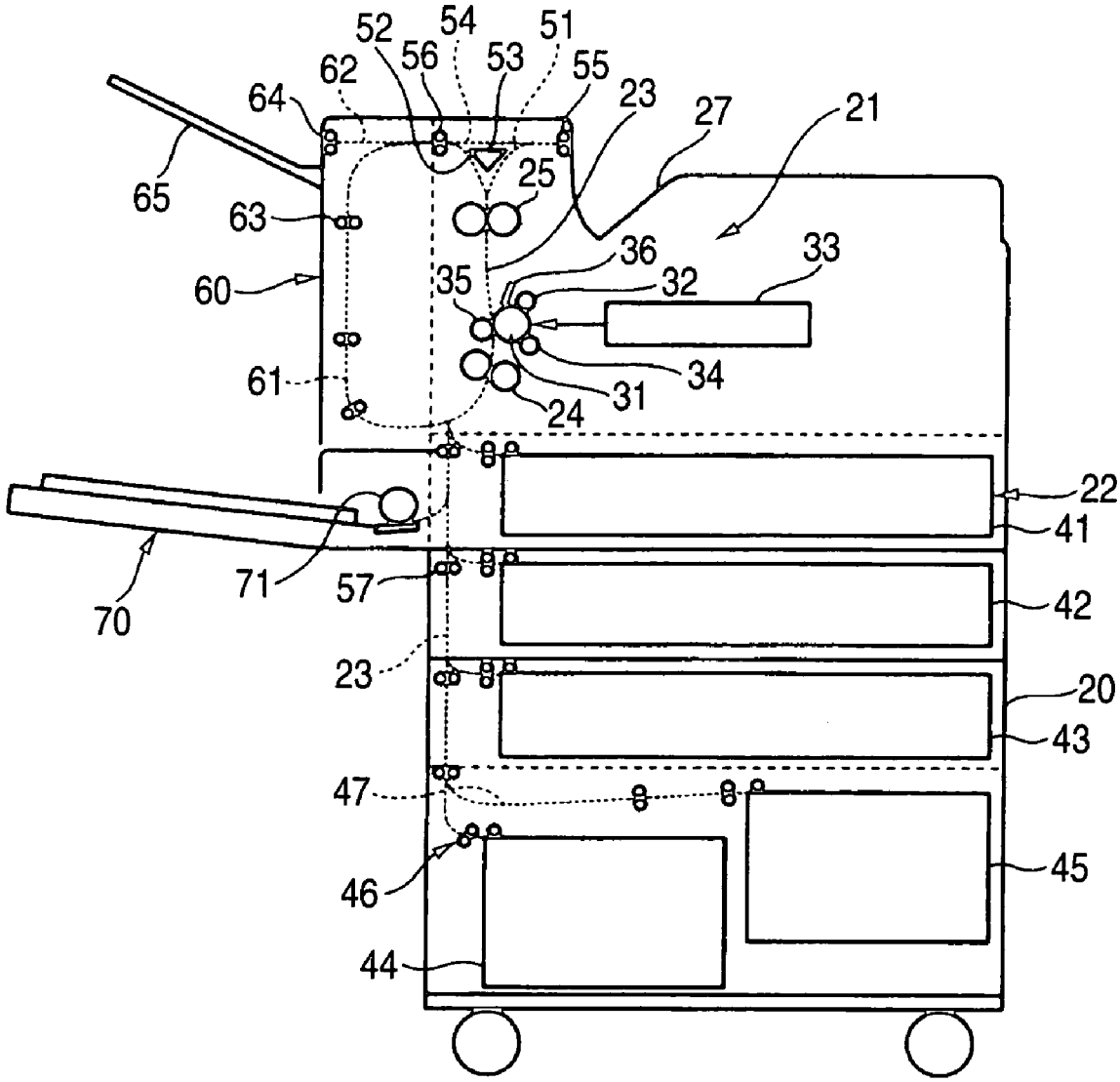
FIG. 2 is an explanatory view showing Embodiment 1 of an image forming apparatus to which the present invention has been applied.

FIG. 2 shows an overall construction of Embodiment 1 of an image forming apparatus to which the present invention has been applied.

In the same drawing, for the image forming apparatus, an imaging engine 21 in, for example, an electrophotographic method is mounted in an apparatus body 20, a feed tray 22 of transfer media (transfer paper, OHP sheets) is equipped below the imaging engine 21, and an upper portion of the apparatus body 20 is constructed as a discharge tray 27, and at one lateral side (equivalent to the left side in FIG. 2) inside the apparatus body 20, a transporting path 23 for guiding a transfer medium sent out of the feed tray 22 to the imaging engine 21 and discharge tray 27 is provided in an approximately the vertical direction.

In the present embodiment, the imaging engine 21 employs, for example, an electrophotographic method and includes a photoconductor drum 31 as an image carrier, an electrification device (in the present example, a charging roll) 32 to electrically charge this photoconductor drum 31, an exposure device 33 such as a laser scanning device to write an electrostatic latent image (hereinafter, referred to as a latent image) on the charged photoconductor drum 31, a development device 34 to toner-develop a latent image on the photoconductor drum 31, a transfer device 35 to transfer a visible image (a toner image) on the photoconductor drum 31 to a transfer medium, and a cleaning device 36 to clean a toner residue on the photoconductor drum 31.

Herein, as a toner to be used in the developing device 34, used is a high-triboelectric non-magnetic toner whose amount of charge is 10 to 40 μC/g under a high-humidity environment (a temperature of 28° C./a humidity of 85%, for example), and whose mean particle diameter is not more than 8 μm.

In addition, as the feed tray 22, for example, multi-tiered (in the present example, three-tiered) cassette trays 41 to 43, and for example, two large-capacity trays 44 and 45 are disposed. Here, for each of the feed tray 22, a feeder 46 to feed a transfer medium is provided, and each of feed tray 22 and the transporting path 23 extending in an approximately vertical direction are connected to communicate with each other via a communicating path 47.

Furthermore, at an upstream side of the photoconductor drum 31 in the transporting path 23, registration rolls 24 for transporting a transfer medium as positioned is provided, and at a downstream side of the photoconductor drum 31 in the transporting path 23, a fixing device 25 is disposed.

And, the transporting path 23 is bifurcated at immediately after the fixing device 25, one branch path 51 extends toward the discharge tray 27, the other branch path 52 extends toward one side wall of the apparatus body 20, and a route switching gate 53 is disposed between both branch paths 51 and 52. Moreover, a straight path 54 to connect both branch paths 51 and 52 linearly is provided, and discharge rolls 55 and 56 are disposed at exit parts of the respective branch paths 51 and 52. Here, a symbol 57 denotes transporting rolls disposed in the transporting path 23 and communicating path 47 as necessary.

In addition, at a side wall of the apparatus body 20 facing the transporting path 23 extending in an approximately vertical direction, a door cover 80 is provided so as to be freely opened and closed, and outside this panel cover 80, a double-sided recording unit 60 is disposed. Inside this double-sided recording unit 60, a return transporting path 61 which is communicated with the branch path 52 and is communicated with an upstream side of the registration rolls 24 in the transporting path 23 is provided, a discharge path 62 is branched midway through this return transporting path 61, an appropriate number of transporting rolls 63 are disposed in the return transporting path 61, and discharge rolls 64 are disposed at an exit part of the discharge path 62. And, a second discharge tray 65 is provided at a position corresponding to the exit of the discharge path 62 of the double-sided recording unit 60.

Here, in FIG. 2, a symbol 70 denotes a manual feed tray to transport a transfer medium by manual feeding, and 71 denotes a manual feeder provided on the manual tray 70.

Figure 3:
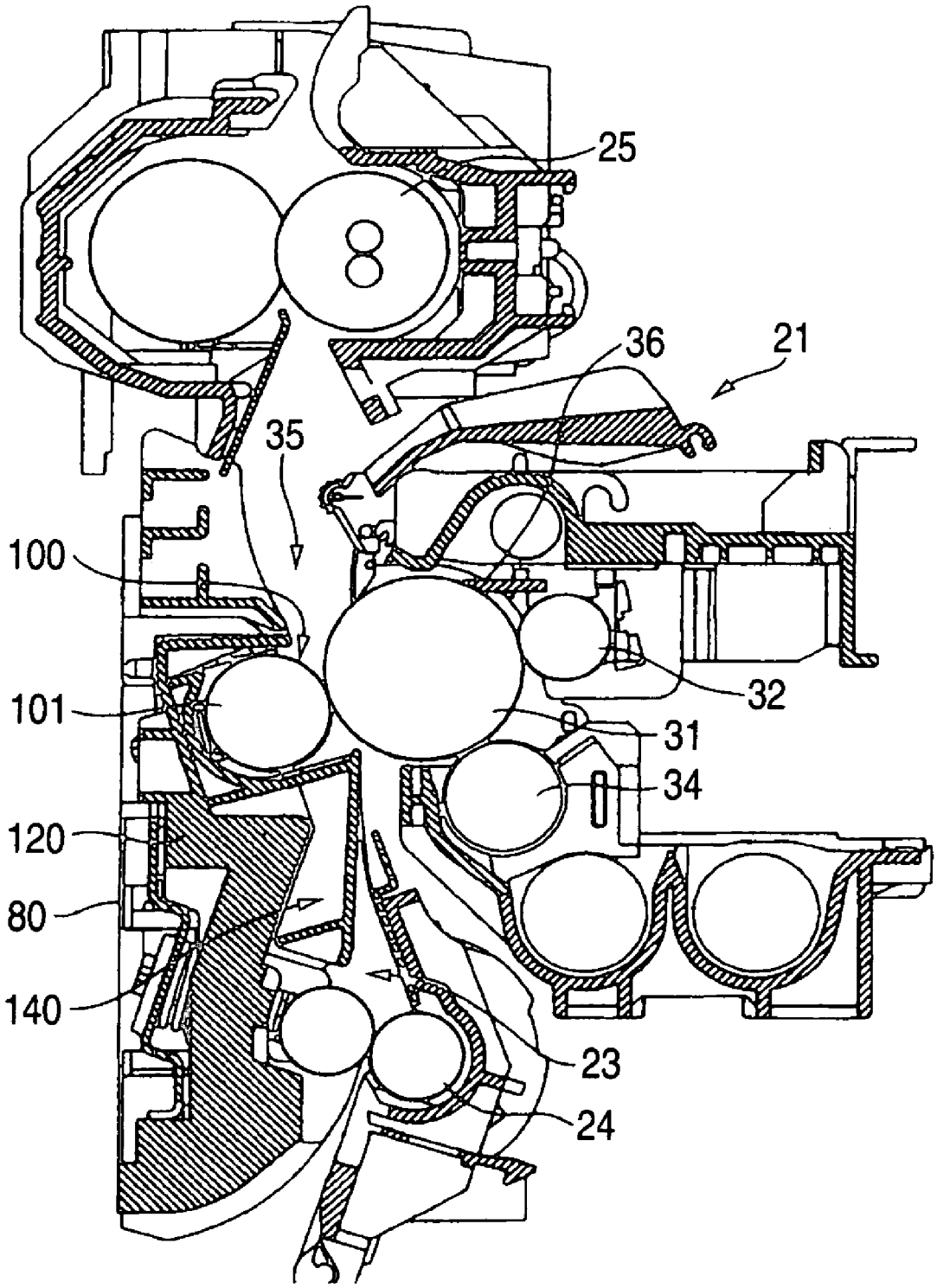
FIG. 3 is an explanatory view showing a main part thereof.
Figure 4:
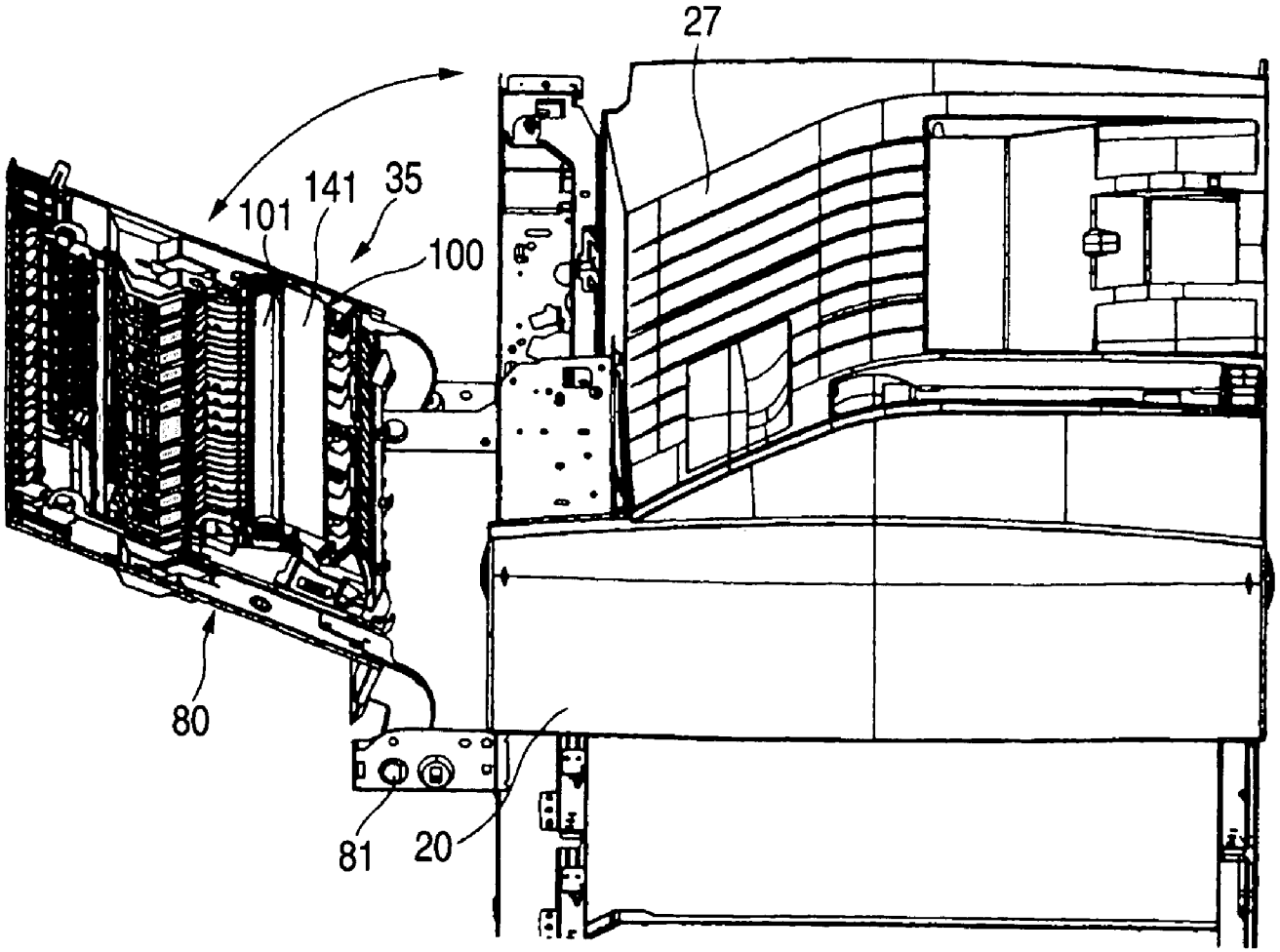
FIG. 4 is an explanatory view showing an apparatus body whose door cover has been opened in a present embodiment.
Figure 5:
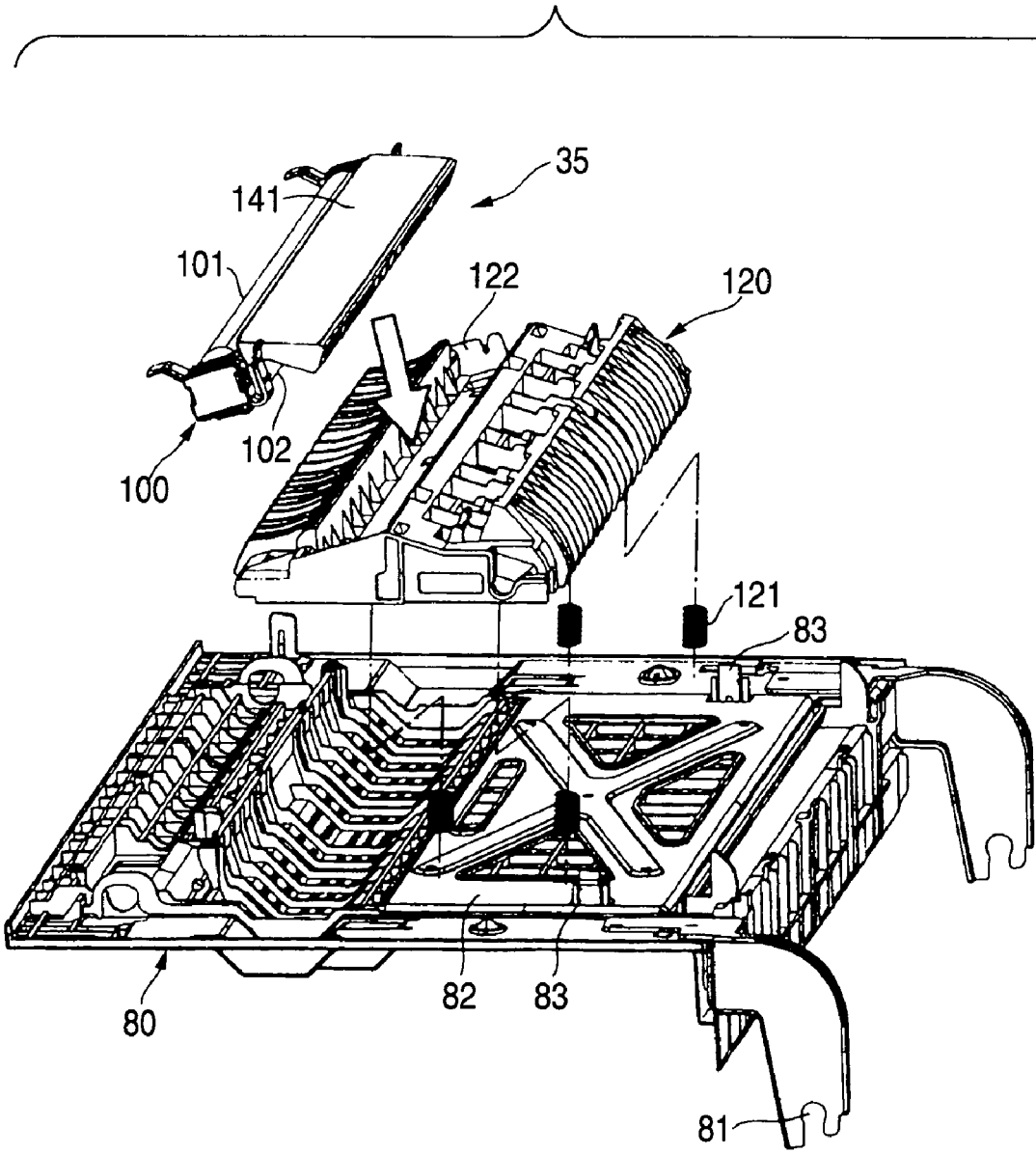
FIG. 5 is an explanatory view showing an attaching structure of a transfer unit to be used in a present embodiment.

In the present embodiment, the door cover 80 of the apparatus body 20 is, in particular, as shown in FIGS. 3 to 5, supported so as to be freely swingable around its lower end portion as a swinging fulcrum 81.

In addition, the transfer device 35 has a transfer unit 100 whose transfer area is secured between the same and photoconductor drum 31, and this transfer unit 100 is held on the door cover 80 via a holding unit 120.

Furthermore, in the transporting path 23, at an upstream side of the transfer area of the transfer unit 100, a transfer medium guiding device 140 is disposed.

Figure 6:
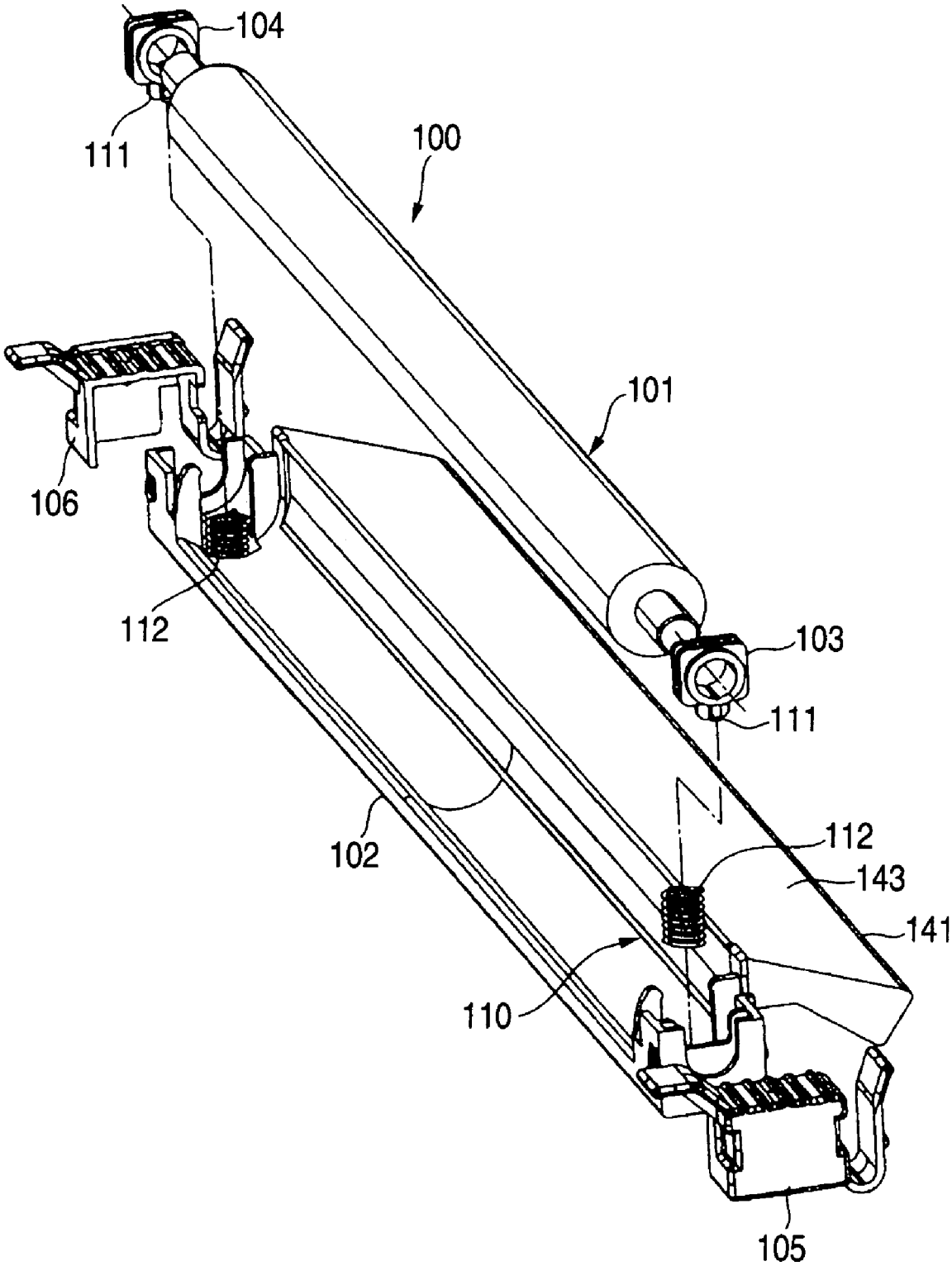
FIG. 6 is an explanatory view showing a positioning mechanism of a transfer unit to be used in the present embodiment.
Figure 7:
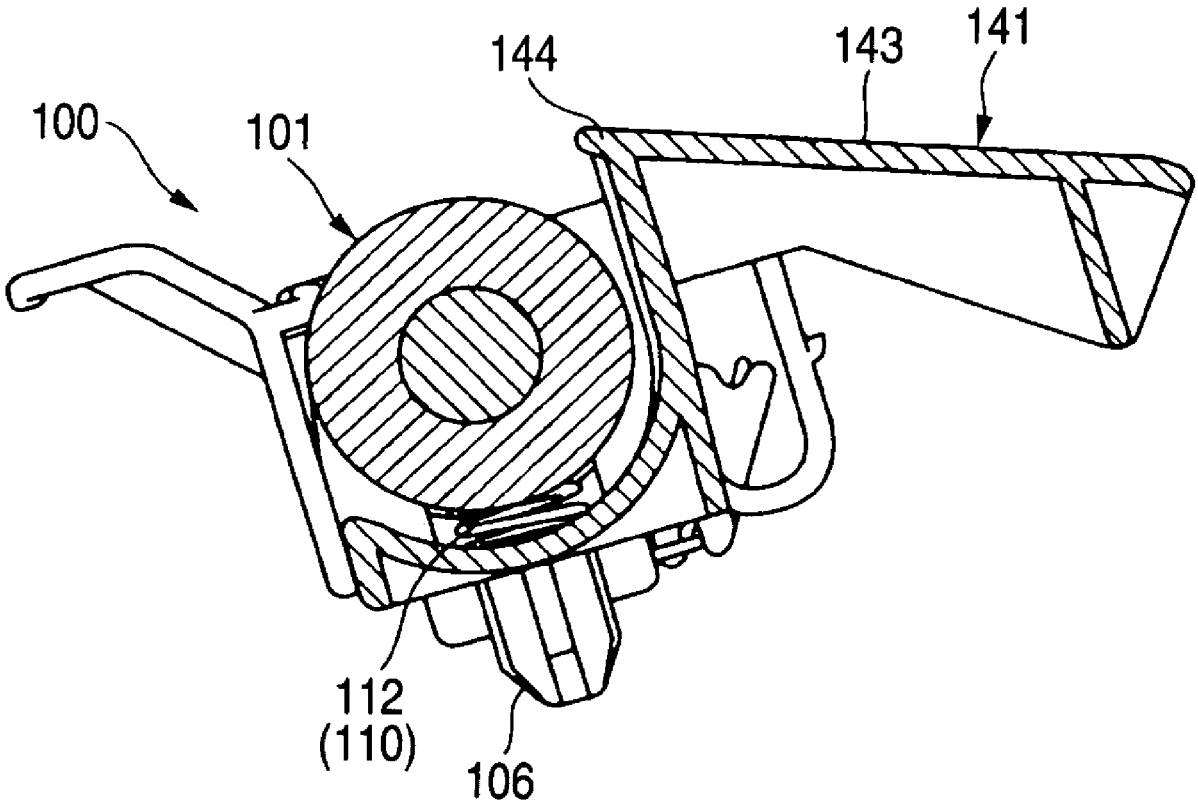
FIG. 7 is a sectional explanatory view of a transfer unit to be used in the present embodiment.

In greater detail, in the present embodiment, the transfer unit 100 has, as shown in FIGS. 6 and 7, a unit holder 102 which is approximately J-shaped in section and which can house a transfer roll 101, and on this unit holder 102, both end axis portions of the transfer roll 101 are supported so as to be freely rotatable via bearing members 103 and 104. Here, a symbol 105 denotes end caps for covering both end portions of the unit holder 102.

And, the unit holder 102 is integrally molded of a resin material such as ABS or polycarbonate, for example, and is provided, at the outside of its bottom portion, with an externally protruding positioning projection 106.

In addition, the transfer roll 101 is elastically supported so as to be relatively shiftable via a positioning mechanism 110. As the positioning mechanism 110 of the present example, used is a mechanism which, by opening a pair of positioning holes (unillustrated) in the vicinities of both ends of the unit holder 102 while providing guide projections 111 which can fit in the positioning holes on the pair of bearing members, respectively, and by latching the guide projections 111 with the positioning holes and winding elastic springs 112 around the guide protrusions 111, elastically supports the bearing members 103 and 104 so as to be freely relatively shiftable.

In addition, as shown in FIGS. 5 and 6, a holding unit receiving portion 82 on which the holding unit 120 can be mounted is provided inside the door cover 80, and on this holding unit receiving portion 82, the holding unit 120 is elastically supported via a predetermined number of (for example, four) elastic springs 121, and this is attached to the door cover 80 in an unbinding condition. Here, a symbol 83 denotes a dropout stopper formed in a protruding condition on both sides in the width direction of the holding unit receiving portion 82, and this regulates a width-direction position of the holding unit 120.

And, on the holding unit 120, a transfer unit receiving portion 122 on which the transfer unit 100 can be mounted is provided, and in this transfer unit receiving portion 122, a positioning hole (unillustrated) is opened, and the transfer unit 100 is freely detachably attached to the holding unit 120 while the positioning protrusion 106 of the unit holder 102 is latched with the positioning hole of the transfer unit receiving portion 122.

Figure 8:
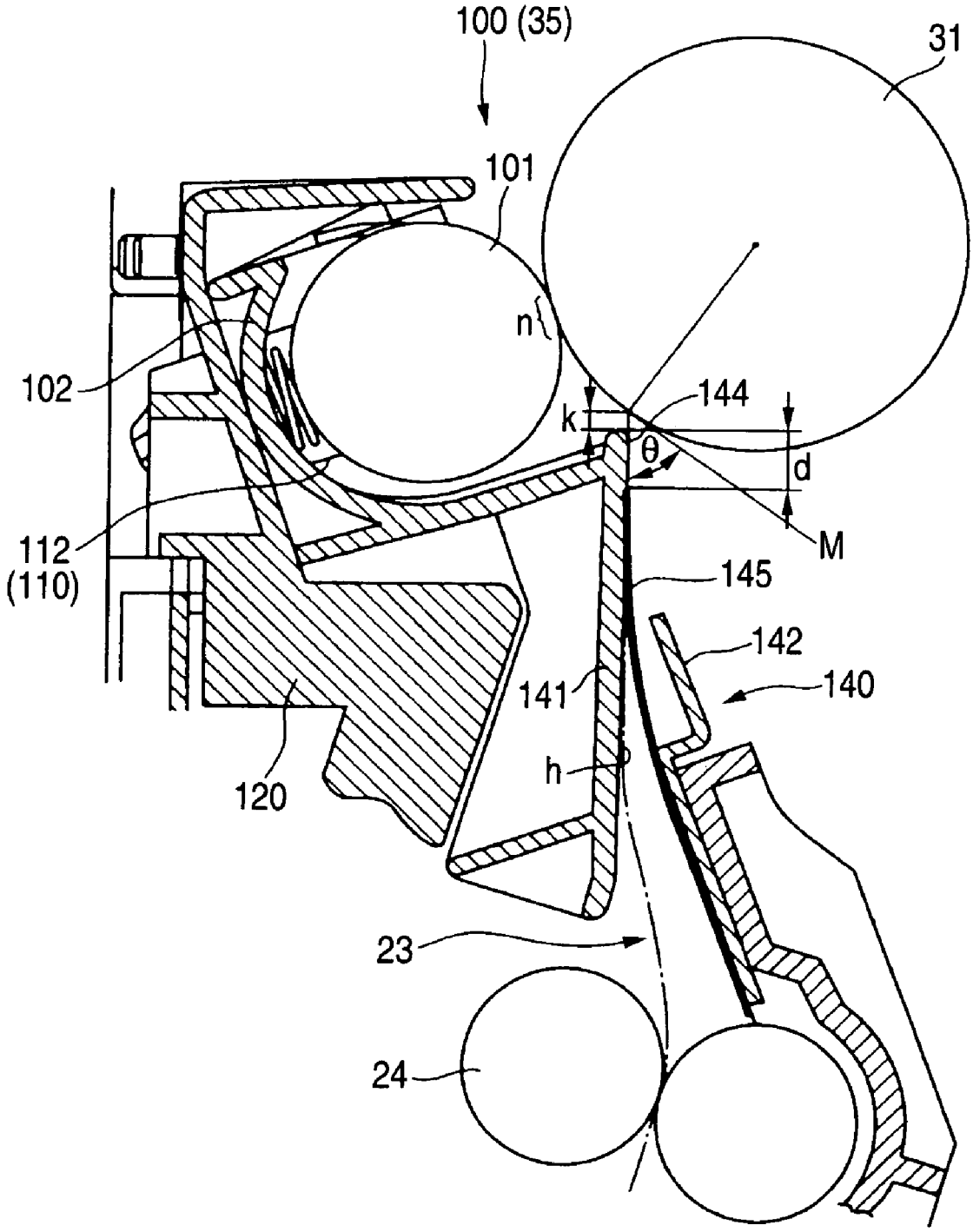
FIG. 8 is an explanatory view showing the detail of a transfer medium guiding device to be used in the present embodiment.

Furthermore, the transfer medium guiding device 140 has, as shown in FIGS. 3 and 8, paired guide chutes 141 and 142 disposed at an upstream side of a transfer area n (equivalent to a contact nipping area between the transfer roll 101 and photoconductor drum 31) of the transfer unit 100 in the transporting path 23. It is sufficient that these guide chutes 141 and 142 guide a transfer medium so that the transfer medium is made to contact an upstream and outside portion of the transfer area n, and in the present example, in order to stabilize a contact posture h of a transfer medium, the transfer medium is guided and transported along the guide chute 141 closer to the transfer area n. Here, a composition raw material of the guide chutes 141 and 142 may be arbitrarily selected regardless of a metallic or resinous material.

In particular, in the present embodiment, the guide chute 141 closer to the transfer area n is, as shown in FIGS. 3 to 8, constructed integrally with the unit holder 102 of the transfer unit 100. Namely, this guide chute 141 has a transporting surface 143 extending along the transfer medium transporting path 23 from an end portion, at the near side of the transfer area n, of the unit holder 102 formed in an approximately J-shape in section and regulates a contact posture h of a transfer medium according to an inclined posture of this transporting surface 143.

And, at a connecting portion between the unit holder 102 and guide chute 141, a projecting portion 144 which is protruding toward the photoconductor drum 31 is integrally formed.

Furthermore, in the present embodiment, a contact posture h of the transfer medium and a gap k between the photoconductor drum 31 and projecting portion 144 are selected as follows.

Namely, as shown in FIG. 8, where an angle (a contact angle of the transfer medium) formed between the contact plane M and transfer medium in a contact posture h (in the present embodiment, equivalent to the transporting surface 143 direction of the guide chute 141 closer to the transfer area n) at a contact part of the transfer medium into the photoconductor drum 31 is provided as $\theta$, $45° \leqq \theta \leqq 60°$. This numerical range is based on that, if the transfer contact angle $\theta$ is less than 45°, adhesion between the photoconductor drum 31 and transfer medium becomes difficult, and if it exceeds 60°, transportability of the transfer medium to the transfer area n is lost.

In addition, the gap k between the photoconductor drum 31 and projecting portion 144 is set so as to satisfy $0.1\ \text{mm} \leqq k \leqq 2.5\ \text{mm}$. This numerical range is based on that, if the gap k is less than 1.0 mm, transportability of the transfer medium to the transfer area n is lost, and if it exceeds 2.5 mm, adhesion between the photoconductor drum 31 and transfer medium is lost by a floating up of the transfer medium with a strong resilience.

Herein, as a contact point of the transfer medium into the photoconductor drum 31, it is sufficient that the point is deviated to an upstream side of the photoconductor drum 31 with respect to a linear position connecting the centers of the photoconductor drum 31 and transfer roll 101, while in order to secure adhesion of the transfer medium in the transfer area n, the deviation angle may be 10°, and in consideration of transportability of the transfer medium, the deviation angle may be not more than 90°.

In addition, in the present embodiment, a flexible retainer member 145 is provided at the photoconductor drum 31 side of the guide chutes 141 and 142. This flexible retainer member 145 is composed of a flexible film piece such as polyethylene terephthalate, for example, and the flexible film piece is cantilever-supported on the guide chute (guide chute positioned on the right side in the drawing) 142 on the side distant from the transfer area n, and a free end of the flexible film piece is elastically arranged in contact in the vicinity of the exit of the transfer medium transporting surface 143 (see FIG. 7) of the guide chute (guide chute positioned on the left side in the drawing) 141 closer to the transfer area n.

This flexible retainer member 145 is for preventing the transfer medium transporting surface 143 of the guide chutes 141 and 142 from being contaminated by a toner cloud from the development device 34 (see FIG. 3), and for preventing, by holding down a trail edge spring of the transfer medium, vibration and the like of the transfer medium as a result of a trail edge spring of the transfer medium, whereby suppressing a transfer failure (an image distortion and the like) in the transfer area n from occurring.

In particular, in the present embodiment, where a distance between the lead edge of the guide chute 141 closer to the transfer area n (more specifically, the lead edge of the projecting portion 144) and the lead edge of a contact portion with the flexible retainer member 145 is provided as d, 3.5 mm≦d≦5.5 mm is satisfied. This numerical range is based on that, with less than 3.5 mm, there is a concern for lead edge contamination of the transfer medium as a result of lead edge contamination of the flexible retainer member 145, while if it exceeds 5.5 mm, there is a concern for an image distortion as a result of a trail edge spring of the transfer medium.

Furthermore, in the present embodiment, an unillustrated control device controls an unillustrated transfer bias supply to apply a predetermined bias to the transfer roll 101, and as a control method thereof, various methods may be employed.

Figure 9A:
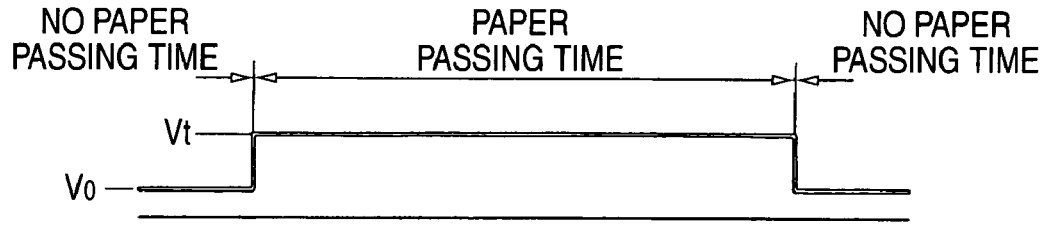
FIGS. 9A to 9C are timing charts showing a transfer control process to be used in the present embodiment.

For example, as shown in FIGS. 8 and 9A, when a transfer medium (for example, a transfer paper) passes through the transfer area n of the transfer unit (paper passing time), normally, a transfer bias Vt is applied, and when no transfer medium passes through the transfer are an (no paper passing time), for example, a cleaning bias V0 (lower in voltage than the transfer bias Vt or a reversed polarity bias) is applied, whereby toner adhesion to the transfer roll 101 is reduced. Here, there is also a method wherein no cleaning bias V0 is applied in the no paper passing time.

Figure 9B:
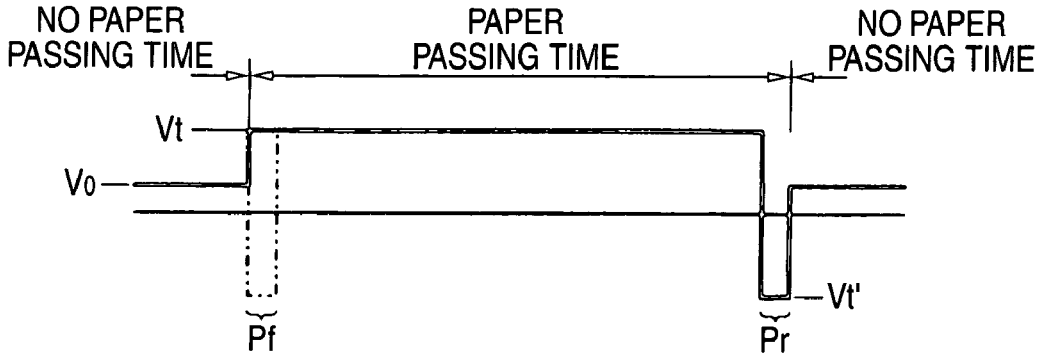

In addition, as shown in FIGS. 8 and 9B, the method may be such that, in the paper passing time, to the part of the transfer medium excluding a trail edge portion Pr, a normal transfer bias Vt is applied, and to the part corresponding to the trail edge portion Pr of the transfer medium, a peeling bias Vt' reverse in polarity to the transfer bias Vt is applied. Since this peeling bias Vt' provides the trail edge portion Pr of the transfer medium with a polarity repulsive to the photoconductor drum 31, the trail edge portion Pr of the transfer medium easily peels from the photoconductor drum 31, and for this, a trail edge spring of the transfer medium when the transfer medium peels is effectively provided. In addition, it may be such that, a transfer bias Vt is not applied in place of the peeling bias Vt' so that electrostatic adhesion power by the transfer bias Vt at the trail edge portion Pr of the transfer medium is weakened. Here, as shown by a virtual line in FIG. 9B, if a peeling bias Vt' is applied or no transfer bias Vt is applied in response to a lead edge portion Pf of the transfer medium, furthermore, peeling performance of the transfer medium becomes excellent.

Figure 9C:
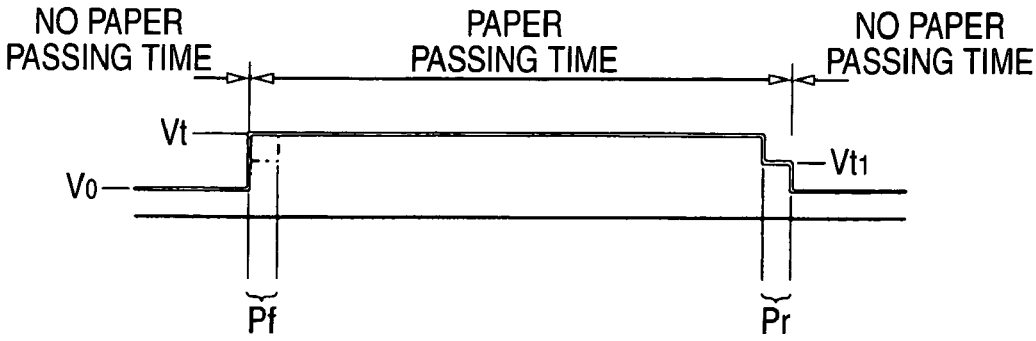

Furthermore, as shown in FIGS. 8 and 9C, the method may be such that, in the paper passing time, to the part of the transfer medium excluding a trail edge portion Pr, a normal transfer bias Vt is applied, and to the part corresponding to the trail edge portion Pr of the transfer medium, a low transfer bias Vt1 which becomes a low current or low voltage with the same polarity as that of the transfer bias Vt is applied. Herein, the low current means that the current is lower than a normal transfer current under constant current control, for example, and the low voltage means that the voltage is lower than a normal transfer bias under constant voltage control, for example. According to the present mode, since electrostatic adhesion power to the photoconductor drum 31 is weakened at the trail edge portion Pr of the transfer medium, the transfer medium easily peels. Here, as shown by a virtual line in FIG. 9C, if a low transfer bias Vt1 is applied in response to a lead edge portion Pf of the transfer medium, furthermore, image transferability is maintained at the lead edge portion Pf of the transfer medium to some degree, and peeling performance of the transfer medium becomes excellent.

In particular, in the present embodiment, as the transfer roll 101, a semiconductive member by forming, at least, a semiconductive elastic layer on the outer circumference of a conductive support (roll base) is used. Here, this semiconductive member is a conductive and semiconductive member (hereinafter, collectively referred to as a semiconductive member) used as various devices of an image forming apparatus, for example, a charging member, a transfer member, a primary transfer member and a secondary transfer member in an intermediate transfer method, a cleaning member, a diselectrifying unit and the like, and the shape is not limited to a roll form but may be in a blade form.

Next, the semiconductive member used in the present embodiment has the following contents (A) to (C) as essential contents, and is characterized in being formed by a rubber composition which contains the content (C) in a range of 10 to 80 parts by mass with respect to a total amount of 100 parts by mass of the content (A) and content (B);

(A) Epichlorohydrin-allyl glycidyl ether copolymer (B) Acrylnitrile butadiene rubber (NBR)

(C) Electronic conductive material

As such, the semiconductive member used in the present embodiment essentially has a semiconductive elastic body layer including the above-described the contents (A) to (C).

As in the present embodiment, by forming the semiconductive elastic body layer by a rubber composition using, in combination, epichlorohydrin-allyl glycidyl ether copolymer (content A) with a high ion conductivity and NBR (acrylnitrile butadiene rubber) (content B) with a low ion conductivity, conductivity of the semiconductive elastic body layer is controlled by ion conductivity, and voltage dependency of electrical resistance is lowered. And, by blending this rubber composition with an electronic conductive conductant agent (content C) at a predetermined amount, electrical resistance under low-temperature and low-humidity is lowered to approximate an electrical resistance under high-temperature and high-humidity. As a result, the electrical resistance value is not greatly fluctuated either under low-temperature and low-humidity or under high-temperature and high-humidity, and is hardly affected by the environment such as temperature, humidity and the like. Namely, environmental dependency is lowered. In addition, since no low-molecular ion conductant agent is added, there is no problem of blooming, and consequently, contamination of the semiconductive member surface and photoconductor surface.

In addition, rubber contents used in the present embodiment are epichlorohydrin-allyl glycidyl ether copolymer (content A) and NBR (content B). The epichlorohydrin-allyl glycidyl ether copolymer (content A) and NBR (content B) are high in compatibility and are uniformly dispersed when blended. As a result, a rubber material with small resistance variation is provided. A compounding ratio of the epichlorohydrin-allyl glycidyl ether copolymer (content A) and NBR (content B) may be set in, by mass ratio, a range of (A)/(B) =80/20 to 20/80, and preferably, a range of (A)/(B)=60/40 to 40/60.

Namely, in terms of the compounding ratio (compounding proportion), when the epichlorohydrin-allyl glycidyl ether copolymer (content A) is less than 20 [NBR (content B) exceeds 80], the obtained semiconductive member tends to have a high initial electrical resistance, and when the epichlorohydrin-allyl glycidyl ether copolymer (content A) exceeds 80 [NBR (content B) is less than 20], ion conductivity is strong, and electrical resistance is likely to have a high environmental dependency. Accordingly, it is necessary to increase the amount of addition of the electronic conductive conductant agent, and a problem of high roll hardness and the like may occur.

In addition, as in the present embodiment, when epichlorohydrin-allyl glycidyl ether copolymer (content A) and NBR (content B) are both used for the rubber composition to form a semiconductive elastic body layer, since the NBR (content B) can be polymerized with a low viscosity, in extrusion molding and the like, a reduction in extrusion pressure and an improvement effect in the extrusion surface can be obtained.

For the material to form the semiconductive elastic body layer, as mentioned in the foregoing, epichlorohydrin-allyl glycidyl ether copolymer (content A), NBR (content B), and an electronic conductive conductant agent (content C) are contained as essential contents, and a rubber composition for which, with respect to a total amount of 100 parts by mass (hereinafter, abbreviated to "parts," as appropriate) of the content (A) and content (B), which are rubber contents, the content (C) is set to a range of 10 to 80 parts by mass is used. More preferably, the content (C) is in a range of 30 to 70 parts. If the content (C) is in this range, the margin of fluctuation of electrical resistance caused by an environmental change and a change in voltage of an obtained semiconductive member can be efficiently reduced.

Namely, if the blending amount of the electronic conductive conductant agent (content C) is less than 10 parts, there is a tendency not to produce an effect of electronic conduction to influence the above-described margin of fluctuation, and if it exceeds 80 parts, hardness of the semiconductive roller is hardened, and a problem such that a nipping pressure at the transfer portion is increased may occur.

As the electronic conductive conductant agent (content C), although carbon black, graphite, a metal or alloy such as aluminum, nickel, or a copper alloy, a metal oxide such as a tin oxide, a zinc oxide, potassium titanate, or a multiple oxide of tin oxide-indium oxide or tin oxide-antimony oxide or the like can be mentioned, of these, carbon black is preferable.

Carbon black preferred as an electronic conductive conductant agent (content C) has the property to be bonded in a chain form in a rubber composition to which the same has been added, and the resistance value of the rubber composition is different according the length of such a chain composition. If this chain composition is long, conductivity of the semiconductive elastic body layer is improved and its resistance value is lowered. On the other hand, if the chain composition is short, conductivity of the semiconductive elastic body layer is lowered and its resistance value is heightened. Namely, when carbon black to form a long chain composition is added, an amount of addition of carbon black to express a desirable resistance value can be reduced compared to that of carbon black to form a short chain composition, however, since the resistance value is greatly changed, the aforementioned variation in the resistance value within the semiconductive elastic body layer cannot be reduced.

In addition, as the electronic conductive conductant agent (content C) in the present embodiment, it is also preferable to use two types of carbon black different in the characteristics such as surface characteristics in combination.

The length of the above-mentioned chain composition is dependent on the particle diameter and surface activity of respective particles of carbon black, and as one of the indexes to indicate the same, DBP (dibutyl phthalate) oil absorption as defined in ASTM D2414-6TT exists. This DBP oil absorption is expressed by whether a large or small amount of DBP (ml) is absorbed in carbon black of 100 g. It is considered that carbon black which is higher in this DBP oil absorption, that is, larger in the oil absorption amount forms a longer chain composition.

When it is intended to adjust the resistance value of the elastic layer by adding only such carbon black high in DBP oil absorption, the resistance value is greatly changed even by a slight increase or decrease in the amount of addition. Therefore, without strictly prescribing the amount of addition and dispersing condition of carbon black, a predetermined resistance value cannot be given to the elastic layer. On the other hand, if it is intended to adjust the resistance value of the elastic layer by adding only carbon black low in DBP oil absorption, since carbon black is almost uniformly dispersed in the rubber composition compared to when only carbon black high in DBP oil absorption is added, the rate of change in the resistance value as a result of an increase or decrease in the amount of addition is reduced. However, in order to give a predetermined resistance value to the elastic layer, it is necessary to add a larger amount of carbon black than that when only carbon black high in DBP oil absorption is added. As a result, since the blending proportion of carbon black in the rubber composition is heightened, a high viscosity occurs when the rubber composition is kneaded by a Banbury mixer, a kneader or the like, which makes processing difficult. In addition, a problem such that the obtained elastic layer has a high hardness may occur.

Accordingly, it is preferable to use two types or more of carbon black different in DBP oil absorption, that is, carbon black high in DBP oil absorption and carbon black low in oil absorption, in combination.

As the above-described carbon black to be added to the forming material of a semiconductive elastic layer, one having a difference in DBP oil absorption is sufficient, however, if this difference is too small, results similar to those when a single type of carbon black is added are produced. Accordingly, as the carbon black, one having a difference in DBP oil absorption to some degree is preferable, and it is preferable to combine ones wherein an oil absorption amount of carbon black high in DBP oil absorption is 250 ml/100 g or more and an oil absorption amount of carbon black low in DBP oil absorption is 100 ml/100 g or less.

Concretely, as carbon black which is high in oil absorption, for example, carbon black and the like such as HS-500 (manufactured by Asashi Carbon Co., Ltd.) whose oil absorption amount is 447 ml/100 g, Ketjenblack (manufactured by LION AKZO CO., LTD.) whose oil absorption amount is 360 ml/100 g, granulated acetylene black (manufactured by Denki Kagaku Kogyo Kabushiki Kaisha) whose oil absorption amount is 288 ml/100 g, and VULCAN XC-72 (manufactured by Cabot Corp.) whose oil absorption amount is 265 ml/100 g can be mentioned. In addition, as carbon black which is low in oil absorption, for example, thermal black and the like such as Asahi Thermal FT (manufactured by Asashi Carbon Co., Ltd.) whose oil absorption amount is 28 ml/100 g, and Asahi Thermal MT (manufactured by Asashi Carbon Co., Ltd.) whose oil absorption amount is 35 ml/100 g can be mentioned.

To the above-described semiconductive elastic body layer, in addition to the aforementioned contents (A) to (C), a crosslinking agent, a filler, a foaming agent and the like are appropriately mixed, as necessary. However, the contents to compose a semiconductive elastic body layer of the present invention contain no ion conductive conductant agent.

As the crosslinking agent, without particular limitation, conventionally known substances, for example, thiourea, triazine, sulfur and the like can be mentioned. As the filler, an insulating filler such as silica, talc, clay, titanium oxide and the like can be mentioned, and these may be used solely or in combination. In addition, as the foaming agent, for example, either an inorganic foaming agent or an organic foaming agent may be used, and these may be solely used, or two types or more may be used in combination.

In the present embodiment, a semiconductive elastic body layer in a semiconductive member can be manufactured by the above-described respective contents by use of mixers such as a tumbler, a V-shaped blender, a Nauta mixer, a Banbury mixer, a kneading roller, an extruder and the like. In addition, a mixing method and a mixing order of the respective contents are not particularly limited when manufacturing a semiconductive elastic body layer in the present embodiment. As a common method, a method of mixing, in advance, all contents by a tumbler, a V blender or the like, and then uniformly melt-blending the same by an extruder is used, however, according to the shapes of the contents, a method of melt-blending two or more types of melt blending substances of these contents with the remaining components can also be used.

Hereinafter, a semiconductive member according to the present embodiment will be described in greater detail.

A conductive support in the semiconductive member of the present embodiment is made of a metal such as SUS or SUM. If the semiconductive member has a roll-formed structure, it is possible that the conductive support is disposed so as to penetrate the semiconductive member in the axis direction and functions as a rotation axis of the semiconductive member. In addition, to the conductive support, since an external power supply is connected and a desirable bias is applied, it also functions as a voltage applying unit to the semiconductive member together with the external power supply.

A semiconductive elastic body layer is formed on the conductive support, and is, as described above, made of a rubber composition containing the contents (A) to (C), and depending on applications of the semiconductive member, hardness, surface characteristics (surface roughness, friction coefficient), electrical characteristics (electrical resistance) and the like are adjusted. By appropriately adjusting various conditions of such electrical characteristics, surface characteristics and the like of the semiconductive elastic body, it can be favorably used as, not to mention a transfer roll, other various types of members (a charging member, a diselectrifying member and the like), as well.

In addition, as the surface characteristics, concretely, roll hardness is preferably adjusted, in terms of ASKER C hardness described in JISK-7312, to a range of 10° to 70°, and for example, when it is used as a transfer roll, the hardness is, more preferably, in a range of 10° to 50°. Here, when it is used as a charging member, the hardness is, more preferably, in a range of 20° to 70°.

As the electrical characteristics, concretely, a volume resistance value of the semiconductive elastic body layer is preferably adjusted to a range of $10^3$ to $10^{10}$ Ω, and more preferably, in a range of $10^6$ to $10^{10}$ Ω when it is used as a transfer roll. Here, when it is used as a charging member, the volume resistance value is, more preferably, in a range of $10^5$ to $10^8$ Ω.

In addition, a voltage resistance value (R) of the semiconductive elastic body layer is determined by placing a roll-formed semiconductive member on a metal plate or the like, applying a load of 500 g, respectively, to both end portions of the semiconductive member, applying a voltage of 1.0 kV (V), reading out a current value I (A) after 10 seconds, and calculating by the following formula.

$$R=V/I$$

In addition, as a thickness of the semiconductive elastic body layer, this is generally set to approximately 2 to 12 mm, and a preferred range is 3 to 5 mm.

Furthermore, the semiconductive elastic body layer is not limited as to its construction as long as the surface characteristics, electrical characteristics and the like have been adjusted according to the application, and this may be made of a single layer or plural layers.

Next, operations of an image forming apparatus according to the present embodiment will be described.

As shown in FIGS. 2 and 3, when forming an image, an unillustrated start switch is operated to start a series of imaging cycle operations.

This imaging cycle is for, while forming a predetermined toner image (image) on the photoconductor drum 31 by an imaging engine 21, sending a transfer medium out of the feed tray 22, leading the same while passing through the transporting path 23 to the transfer device 35 via the registration rolls 24 and transfer medium guiding device 140, transferring the toner image on the photoconductor drum 31 to the transfer medium and, thereafter, discharging the transfer medium to, for example, the discharge tray 27.

In such an imaging cycle, when behavior of a transfer medium led to a transfer area n (transfer area of the transfer roll 101) of the transfer device 35 is focused, as shown in FIG. 8, the transfer medium which has passed through the registration rolls 24 is guided and transported along the guide chute 141 of the transfer medium guiding device 140 closer to the transfer area n, contacts the photoconductor drum 31 at a predetermined contact angle θ, and thereafter, proceeds to the transfer area n in a condition closely fitted to the photoconductor drum 31.

At this time, since the contact angle θ of the transfer medium has been set to (45°≦d≦60°), the transfer medium is maintained in a condition securely closely fitted to the photoconductor drum 31 surface without losing transportability.

In addition, in the present embodiment, since the lead edge (lead edge of the projecting portion 144) of the guide chute 141 closer to the transfer area n is arranged closely to the photoconductor drum 31 with a predetermined gap k (in the present example, 1.0 mm≦k≦2.5 mm), even if a transfer medium with a strong resilience is used, transportability of the transfer medium is satisfactorily maintained, and a floating up of the transfer medium with respect to a curvature of the photoconductor-drum 31 is effectively suppressed.

Accordingly, adhesion of the transfer medium to the photoconductor drum 31 is extremely satisfactorily maintained in the transfer area n, and a situation where the transfer medium partially floats up in the transfer area n and a gap which occurs at this time causes an electric discharge can be sufficiently avoided. Accordingly, a transfer failure (deletion and scattering) as a result of an electric discharge in the transfer area n can be effectively prevented.

In addition, in the present embodiment, since the transfer medium guiding device 140 is provided with the flexible retainer member 145, in a transporting process of the transfer medium, the lead edge of the transfer medium is effectively prevented from being contaminated by a toner cloud, and a trail edge spring of the transfer medium is also held down by the flexible retainer member 145, thereby an image distortion as a result of a trail edge spring of the transfer medium can be effectively provided.

In addition, in the present embodiment, the transfer device 35 is incorporated into the apparatus body 20 as follows.

Namely, when the transfer device 35 is incorporated, as shown in FIGS. 3 to 6, it is sufficient that, after opening the door cover 80, a transfer unit 100 is held inside the door cover 80 via the holding unit 120, and thereafter, the door cover 80 is closed.

At this time, if the door cover 80 is closed, the transfer roll 101 of the transfer unit 100 is made in contact with the photoconductor drum 31, however, since the transfer roll 101 can be relatively shifted by the positioning mechanism 110, positioning is carried out with reference to the photoconductor drum 31 position.

At this time, the holding unit 120 is elastically supported against the door cover 80, and the positioning mechanism 110 elastically supports the transfer roll 101, therefore, the transfer roll 101 is arranged in contact with the photoconductor drum 31 by a suitable pressure, and there is no concern for a contact arrangement by an excessive pressure force.

In addition, in the present embodiment, since the guide chute 141 of the transfer medium guiding device 140 closer to the transfer area n is integrally constructed with the unit holder 102 of the transfer unit 100, when the transfer unit 100 is positioned at a predetermined position with respect to the photoconductor drum 31 of the transfer unit 100, inevitably, position of the guide chute 141 closer to the transfer area n is fixedly determined. At this time, when the transfer unit 100 and the guide chute 141 are separately positioned, positional accuracy as a result of an attachment error is slightly lowered between the transfer unit 100 and guide chute 141, whereas in the present embodiment, since a positional accuracy error as a result of the attachment error as described above can be eliminated, positional accuracy of the guide chute 141 closer to the transfer area n can be extremely sufficiently maintained for this.

Therefore, the contact angle θ of the transfer medium and the gap k between the photoconductor drum 31 and lead edge (lead edge of the projecting portion 144) of the guide chute 141 can be extremely accurately set.

Furthermore, in the present embodiment, since the transfer unit 100 can be detachably attached to the door cover 80, the transfer unit 100 can be simply replaced.

Particularly, in the present embodiment, to the lead edge (lead edge of the projecting portion 144) of the guide chute 141 of the transfer medium guiding device 140, the transfer medium led to the transfer area n often slidably makes contact, therefore, in such a mode of the unit holder 102 manufactured of resin, there is a concern that the projecting portion 144 is gradually worn. However, in terms of the degree of wear of this projecting portion 144, by bringing the same in line with the life of the transfer unit 100, it is possible to satisfactorily maintain transfer medium guiding performance of the transfer medium guiding device 140 in line with a replacement timing of the transfer unit 100.

EXAMPLE 1

In the present example, by use of an image forming apparatus model (see FIG. 8) according to the embodiment, by changing an angle (transfer paper contact angle) θ formed between a photoconductor drum (image carrier) contact plane and a transfer medium (transfer paper) contact posture and a gap k between a photoconductor drum (image carrier) and the lead edge of a left guide chute, respectively, as parameters, presence/absence of an image quality defect (deletion/scattering) and sheet transporting performance (presence/absence of a jam) were evaluated.

In the present example,

Photoconductor drum diameter: 30 mm

Transfer roll diameter: 20 mm

Transfer Paper Contact Point:

A position biased, with reference to a center line position between the photoconductor drum and transfer roll, by 20° to the upstream side.

Results of Embodiment 1 are shown in FIG. 10.

In the same drawing, evaluation criteria are as follows.

Deletion/Scattering:

A: Image quality with no problem can be obtained.

B: Occurs only when stress is around 50% image coverage

C: Occurs in most halftone images

D: Cannot be detected since sheet transport is impossible.

Sheet Transporting Performance (Jam)

A: Can travel without a problem

B: Some sheets with strong resilience (for example: cardboard/film sheet) cannot travel C: Most transfer paper cannot travel According to the same drawing, it can be understood that being $45° \leqq \theta \leqq 60°$ and $1.0\ \text{mm} \leqq k \leqq 2.5\ \text{mm}$ is necessary to prevent image quality defect and to satisfactorily maintain sheet transporting performance.

In addition, a performance evaluation similar to Example 1 was carried out for respective models whose diameter of the photoconductor drum and position of the transfer paper contact point have been changed, and results similar to those mentioned in the foregoing were confirmed for the transfer paper contact angle θ and the gap k.

EXAMPLE 2

In the present example, by use of an image forming apparatus model (FIG. 8) similar to Embodiment 1, by changing a distance d from the lead edge of a guide chute closer to the transfer area (left guide chute) to a flexible member as a parameter, deletion, a transfer paper trail edge spring, and a transfer paper trail edge contamination were evaluated.

In the present example,

Photoconductor drum diameter: 30 mm

Transfer roll diameter: 20 mm

Transfer Paper Contact Point:

A position biased, with reference to a center line position between the photoconductor drum and transfer roll, by 20° to the upstream side.

Transfer paper contact angle θ: 40°

Gap k: 1.5 mm

Results of Embodiment 2 are shown in FIG. 11.

In the same drawing, evaluation criteria are as follows.

Deletion:

A: Image quality with no problem can be obtained.

B: Occurs only when stress is around 50% image coverage

C: Occurs in most halftone images

Transfer Paper Trail Edge Spring:

A: No impact noise owing to a spring is heard.

C: An impact noise owing to a spring is heard.

Transfer Paper Lead Edge Contamination:

A: No contamination or an undetectable level even though it is contaminated,

C: Level that contamination is detectable.

According to the same drawing, it can be understood that being $3.5\ \text{mm} \leqq d \leqq 5.5\ \text{mm}$ is necessary to prevent deletion, a trail edge spring of transfer paper, and a lead edge contamination of transfer paper.

In addition, a performance evaluation similar to Embodiment 2 was carried out for respective models whose diameter of the photoconductor drum and position of the transfer paper contact point have been changed, and results similar to those mentioned in the foregoing were confirmed for the distance d.

By an image forming apparatus according to the present invention, as a transfer medium guiding device, since optimal ranges have been determined for a contact posture of a transfer member into the image carrier and a gap between the guide chute closer to the transfer area and image carrier, adherence between the image carrier and contact transfer member can be secured, and transfer performance by the contact transfer member can be satisfactorily maintained.

In addition, by a transfer medium guiding device according to the present invention, adherence between the image carrier and contact transfer member can be secured, thus an image forming apparatus capable of satisfactorily maintaining transfer performance by the contact transfer member can be simply constructed.

What is claimed is:

1. An image forming apparatus comprising:

an image carrier that supports an image;

a contact transfer member that sandwiches a transfer medium in a transfer area between the contact transfer member and the image carrier and electrostatically transfers the image on the image carrier onto the transfer medium; and a transfer medium guiding device to guide the transfer medium to the transfer area between the image carrier and the contact transfer member, wherein the transfer medium guiding device has a pair of guide chutes that guide the transfer medium to make the transfer medium contact the outside and upstream portion of the transfer area of the image carrier, an angle formed between a contact plane on the image carrier and the transfer medium at a contact point is 45° or more and 60° or less, and a distance between one of the guide chutes closer to the transfer area and the image carrier is 1.0 mm or more and 2.5 mm or less, wherein the transfer medium guiding device comprises a flexible retainer member whose lead edge contacts a transfer medium transporting surface of the guide chute closer to the transfer area, and wherein a distance between a lead edge of the guide chute closer to the transfer area and a lead edge of the flexible retainer member is 3.5 mm or more and 5.5 mm or less.

2. The image forming apparatus as set forth in claim 1, wherein the transfer medium guiding device guides and transports the transfer medium along the guide chute closer to the transfer area.

3. The image forming apparatus as set forth in claim 1, further comprising:

transfer control unit by which a transfer bias to be applied to the contact transfer member is controlled, wherein the transfer control unit applies, in response to a pass timing of at least a trail edge portion of the transfer medium, a bias to be a low current or a low voltage with the same polarity as that of the transfer bias.

4. The image forming apparatus as set forth in claim 1, wherein the image is formed by a high-triboelectric material.

5. The image forming apparatus as set forth in claim 1, wherein the guide chute close to the transfer area is provided integrally with a holder of the contact transfer member.

6. An image forming apparatus comprising:

an image carrier that supports an image;

contact transfer member that sandwiches a transfer medium in a transfer area between the contact transfer member and the image carrier and electrostatically transfers the image on the image carrier onto the transfer medium; and a transfer medium guiding device to guide the transfer medium to the transfer area between the image carrier and the contact transfer member, wherein the transfer medium guiding device has a pair of guide chutes that guide the transfer medium to make the transfer medium contact the outside and upstream portion of the transfer area of the image carrier, and an angle formed between a contact plane on the image carrier and a planar surface of one of the guide chutes at a contact point is constant at 45° or more and 60° or less, and a distance between one of the guide chutes closer to the transfer area and the image carrier is 1.5 mm or more and 2.5 mm or less.

7. The image forming apparatus as set forth in claim 6, wherein the transfer medium guiding device comprises a flexible retainer member whose lead edge contacts a transfer medium transporting surface of the guide chute closer to the transfer area.

8. The image forming apparatus as set forth in claim 7, wherein a distance between a lead edge of the guide chute closer to the transfer area and a lead edge of the flexible retainer member is 3.5 mm or more and 5.5 mm or less.

* * * * *